US006435885B2

(12) United States Patent
Araki et al.

(10) Patent No.: US 6,435,885 B2
(45) Date of Patent: Aug. 20, 2002

(54) ROTARY CONNECTOR AND CONNECTING STRUCTURE OF FLEXIBLE CABLE AND LEAD BLOCK USED THEREIN

(75) Inventors: Shunji Araki; Ichiro Shirako, both of Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/886,888

(22) Filed: Jun. 21, 2001

(30) Foreign Application Priority Data

Jun. 22, 2000 (JP) ..... 2000-188085

(51) Int. Cl.[7] ..... H01R 35/04
(52) U.S. Cl. ..... 439/164; 439/874
(58) Field of Search ..... 439/164, 15, 874

(56) References Cited

U.S. PATENT DOCUMENTS 5,683,259 A * 11/1997 Sato ..... 439/164
5,827,081 A * 10/1998 Sakamaki ..... 439/164
5,833,476 A * 11/1998 Sakamaki ..... 439/164
5,951,322 A 9/1999 Nishikigi ..... 439/456
5,980,285 A * 11/1999 Matsumoto ..... 439/164
6,007,355 A * 12/1999 Shibata et al. ..... 439/164
6,116,930 A * 9/2000 Sakata ..... 439/164
6,257,909 B1 * 7/2001 Schroer et al. ..... 439/164

* cited by examiner

*Primary Examiner*—Gary F. Paumen
(74) *Attorney, Agent, or Firm*—Brinks Hofer Gilson & Lione

(57) ABSTRACT

A flexible cable is constructed in a band-like shape by sandwiching a plurality of conductive wires with a pair of insulating films, and a lead block is constructed by fixing a plurality of joint bars to a resin body. In a connecting structure of the flexible cable and the lead block, a part of one of the insulating films is removed so that the conductive wires are exposed at an end of the flexible cable. In addition, through holes for preventing deformation are formed in the remaining insulating film at positions between the exposed parts of the conductive wires. The exposed parts of the conductive wires are connected to the joint bars at positions close to the through holes by ultrasonic welding.

3 Claims, 7 Drawing Sheets

ROTARY CONNECTOR AND CONNECTING STRUCTURE OF FLEXIBLE CABLE AND LEAD BLOCK USED THEREIN

BACKGROUND OF THE INVENTION

1. Field of the Invention

The present invention relates to rotary connectors for electrically connecting an electrical device disposed in a rotor section of a steering apparatus and an electrical device disposed in a stator section thereof. In addition, the present invention also relates to connecting structures of a flexible cable and a lead block used in the rotary connectors.

2. Description of the Related Art

Conventionally, rotary connectors which include a pair of housings which are concentrically disposed and are linked together so as to be rotatable relative to each other; a flexible cable which is contained in a space between the housings in such a manner that the flexible cable is able to be wound and be loosened therein; and one or two lead block(s) which is/are connected to one or both end(s) of the flexible cable, are known in the art. The end of the flexible cable to which the lead block is connected is fixed to one of the housings at a predetermined position and is electrically connected to the external environment via lead wires or an external connector connected to the lead block. In addition, the end of the flexible cable to which the lead block is not connected is directly fixed to one of the housings at a predetermined position and is electrically connected to the external environment. One of the housings is movable, and the other one is immovable.

In the rotary connectors constructed as described above, the immovable housing is fixed to a steering column of a steering apparatus, and the movable housing is fixed to a steering wheel thereof. In addition, both ends of the flexible cable are individually connected to electrical components disposed in the steering column and in the steering wheel. Thus, the rotary connectors are used to form an electrical connection for air bag systems, horn circuits, etc.

The flexible cable is constructed by arranging a plurality of conductive wires in a parallel manner and sandwiching the conductive wires with a pair of insulating films, and has a band-like shape of a predetermined length. In addition, the lead block is constructed by connecting a plurality of joint bars formed of a conductive material with an insulating supporter. The joint bars are arranged with the same pitch as the pitch between the conductive wires.

The flexible cable and the lead block are connected to each other by the following process. First, a part of one of the insulating films in the flexible cable is removed so that the conductive wires are exposed at the remaining insulating film at an end of the flexible cable. Then, the thus exposed conductive wires are connected to the joint bars in the lead block using a connecting device such as an ultrasonic welding device, etc. When the ultrasonic welding device is used as the connecting device, a welding tip installed in the ultrasonic welding device is pressed against the flexible cable from above, so that the conductive wires and the joint bars, which oppose each other, are welded pair by pair.

When the welding tip is pressed against the flexible cable from above and a transmitter installed in the ultrasonic welding device is activated, ultrasonic energy transmitted from the transmitter is concentrated at the pressing part of the welding tip. Then, the ultrasonic energy is converted into heat, by which a part of the insulating film melts and one conductive wire and one joint bar are welded.

As described above, the conductive wires in the flexible cable and the joint bars in the lead block are not welded simultaneously, but are welded pair by pair. When a pair including one conductive wire and one joint bar is processed by ultrasonic welding, the insulating film partly melts at regions surrounding the welded part. Thus, even when the conductive wires and the joint bars are accurately positioned in advance, a displacement occurs between the conductive wires and the joint bars which have not yet been processed by the ultrasonic welding. When the conductive wires and the joint bars are sequentially connected by performing the ultrasonic welding to one pair, then to the adjacent pair, and so forth, partial deformation of the flexible cable due to the melting of the insulating film accumulates every time a pair is welded. Thus, the largest amount of displacement occurs at the pair which is welded last.

Accordingly, in a connecting structure of a flexible cable and a lead block in which an allowable displacement is small, for example, when the widths of the conductive wires and the joint bars are small or when the number thereof is large, it becomes difficult to establish adequate electrical connections between the conductive wires and the joint bars. Thus, connection failures easily occur. In addition, in order to prevent the connection failures, the connecting parts of the conductive wires and the joint bars must be fixed with a special jig. Accordingly, the efficiency of connecting the flexible cable and the lead block is reduced, and the cost of the rotary connector is increased.

Since the number of electrical components installed in a steering apparatus has recently increased, it is strongly demanded that the number of conductive wires in the flexible cable of the rotary connector is also increased without increasing the width of the flexible cable. In order to satisfy such a demand, the pitch between the conductive wires must necessarily be reduced. Accordingly, the above-described disadvantages have become increasingly serious.

The above described disadvantages occur not only in cases in which the ultrasonic welding device is used, but also in cases in which other welding devices or soldering devices are used, as long as the conductive wires and the joint bars are welded pair by pair.

SUMMARY OF THE INVENTION

In view of the above-described situation of the conventional technique, an object of the present invention is to provide a connecting structure of a flexible cable and a lead block in which conductive wires and joint bars are easily connected with increased accuracy. In addition, it is also an object of the present invention to provide a rotary connector including a flexible cable and a lead block having such a connecting structure.

In order to solve the above-described problems, a rotary connector according to the present invention includes a pair of housings which are concentrically disposed and are linked together so as to be rotatable relative to each other; a flexible cable which is contained in a space between the housings in such a manner that the flexible cable is able to be wound and loosened therein, and which is formed in a band-like shape by sandwiching a plurality of conductive wires with two insulating films; and a lead block which is connected to an end of the flexible cable and has such a construction that a plurality of joint bars which are conductive are connected by an insulating supporter. In a part of the flexible cable which is connected to the lead block, one of the two insulating films is removed so that the end portions of the conductive wires are exposed at the remaining insulating film, through holes being formed in the remaining insulating film at positions between the exposed conductive wires, and the exposed conductive wires being electrically connected to the joint bars at positions close to the through holes.

Accordingly, when a pair including one conductive wire and one joint bar is welded, the remaining insulating film partly melts. However, since the through holes are formed in the remaining insulating film at positions close to the positions at which the conductive wires and the joint bars are connected, the partial deformation of the flexible cable due to the melting of the insulating film can be absorbed by the through holes. Accordingly, the displacement between the conductive wires and the joint bars which have not yet been connected can be made zero or be reduced. Thus, adequate electrical connections can be established for all the conductive wires and the joint bars, and connection failures can be prevented.

In addition, a connecting structure of a flexible cable and a lead block according to the prevent invention includes a flexible cable which is formed in a band-like shape by sandwiching a plurality of conductive wires with two insulating films; and a lead block which has such a construction that a plurality of conductive joint bars are connected by an insulating supporter. In a part of the flexible cable which is connected to the lead block, one of the two insulating films is removed so that the end portions of the conductive wires are exposed at the remaining insulating film, through holes being formed in the remaining insulating film at positions between the exposed conductive wires, and the exposed conductive wires being electrically connected to the joint bars at positions close to the through holes.

Accordingly, since special jigs or operations for fixing the flexible cable are not required, the connecting. process of the flexible cable and the lead block can be made simpler, and the manufacturing cost of the rotary connector can be reduced. The number of the through holes formed in the insulating film may be determined in consideration of the amount of deformation which occurs in the connecting process. When the amount of deformation is large, the through holes may be provided between all the conductive wires, and when the amount of deformation is small, the through holes may be provided between only some of the conductive wires. In addition, the size of the through holes formed in the insulating film may be adjusted in consideration of the amount of deformation which occurs in the connecting process, within a range in which the shape and the arrangement of the conductive wires are not affected.

The through holes may be provided between all the conductive wires on the remaining insulating film and be arranged in a line. Alternatively, the through holes may be provided between only some of the conductive wires on the remaining insulating film.

DESCRIPTION OF THE PREFERRED EMBODIMENT

A rotary connector and a connecting structure of a flexible cable and a lead block used therein according to an embodiment of the present invention will be described below with reference to the accompanying drawings.

Figure 1:
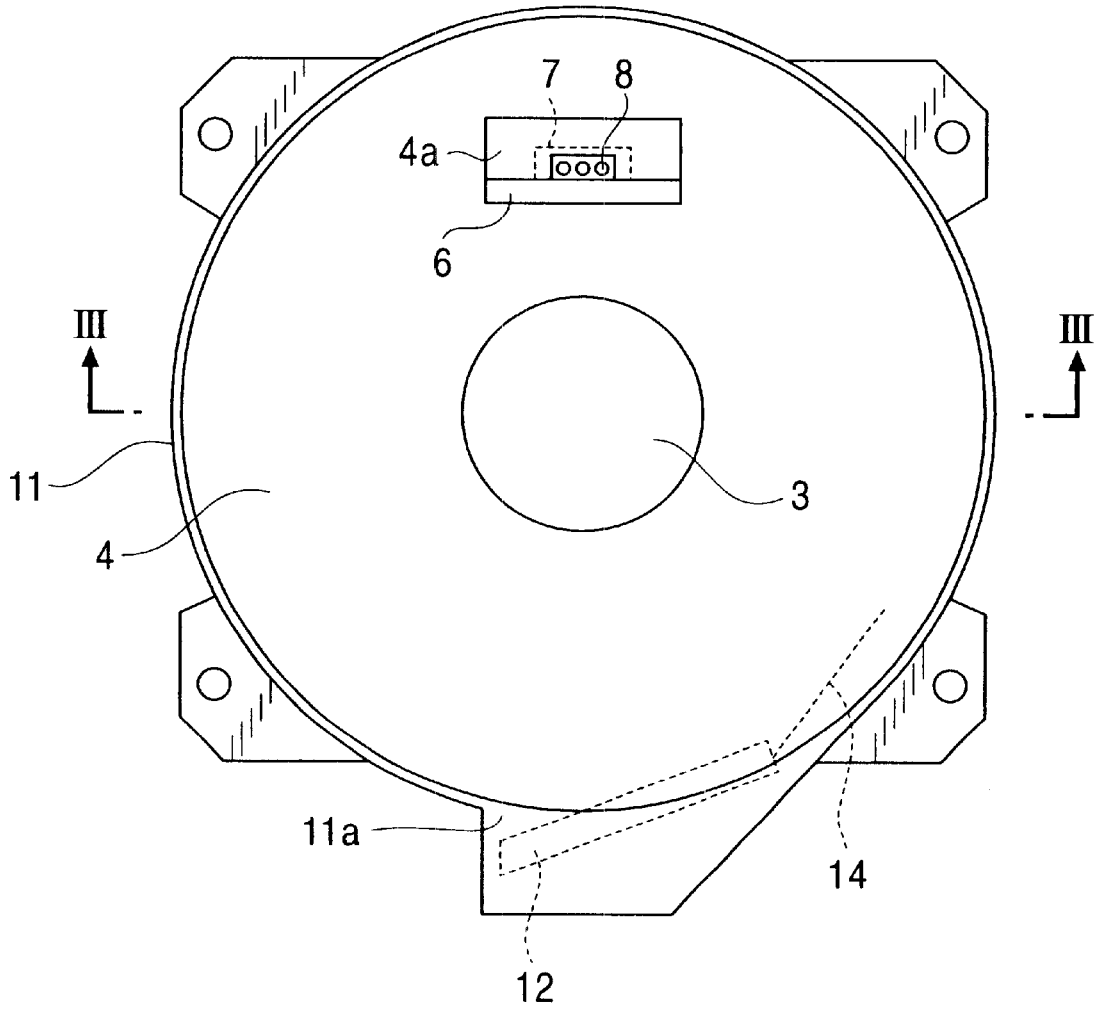
FIG. 1 is a plan view of a rotary connector according to an embodiment.
Figure 2:
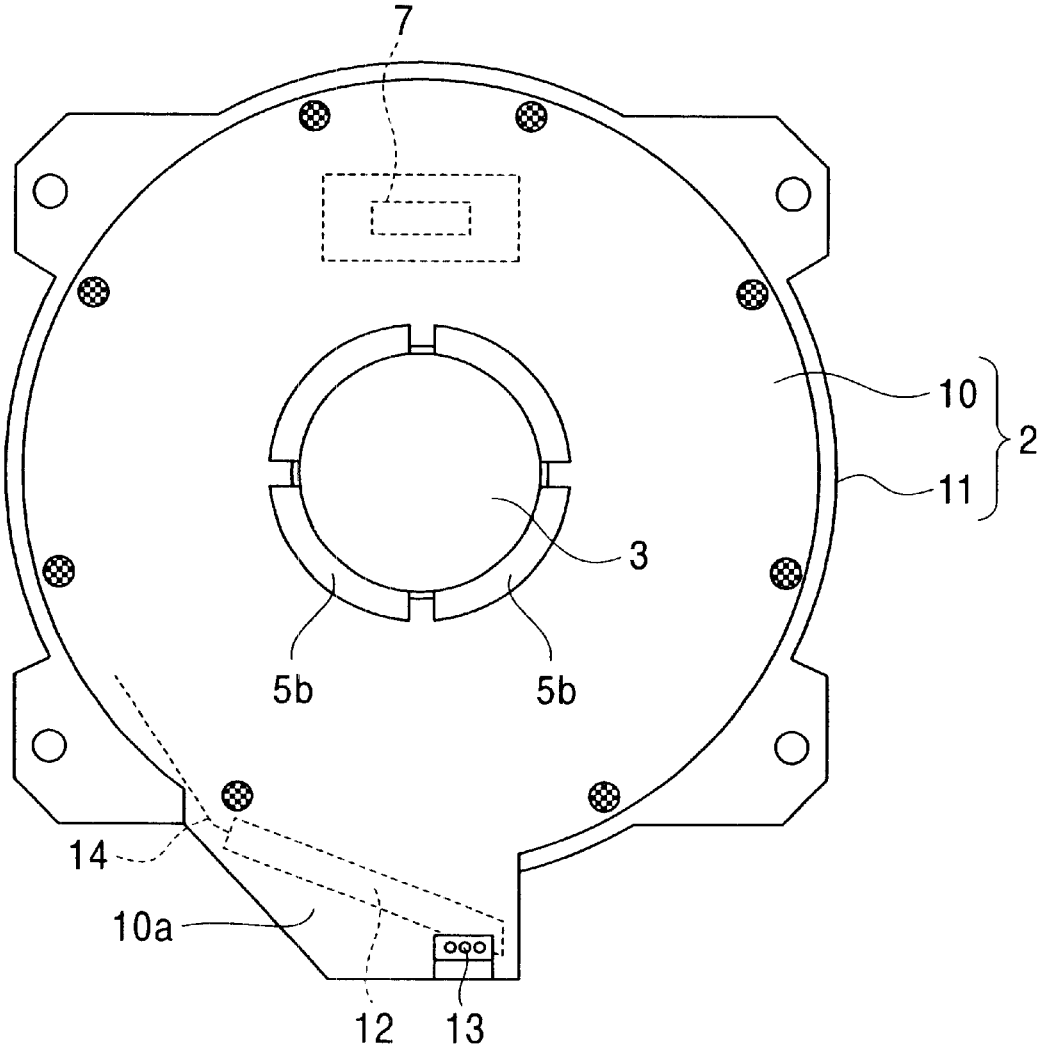
FIG. 2 is a bottom view of the rotary connector according to the embodiment.
Figure 3:
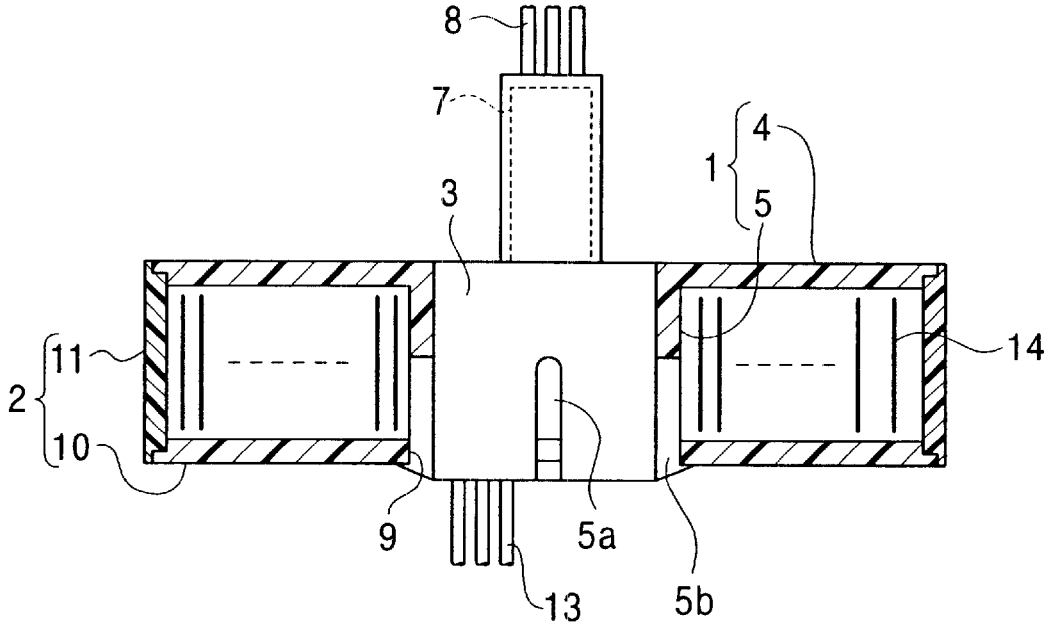
FIG. 3 is a sectional view of FIG. 1 which is cut along line III—III.

FIG. 1 is a plan view of the rotary connector according to the embodiment of the present invention, FIG. 2 is a bottom view of the rotary connector, and FIG. 3 is a sectional view of FIG. 1 which is cut along line III—III. In the figures, reference numeral 1 denotes a first housing, and reference numeral 2 denotes a second housing. In the present embodiment, the first housing 1 is movable and the second housing 2 is immovable.

The first housing 1 is constructed with a circular top plate 4 which is provided with a central hole 3, and an inner cylinder 5 which extends downward from the periphery of the central hole 3. The inner cylinder 5 is provided with a plurality of slits 5*a*, which extend in the axial direction of the central hole 3, at the lower region thereof. In addition, claw portions 5*b* are formed at the lower end of the inner cylinder 5. In addition, the top plate 4 is provided with a protruding portion 4*a* which is integrally formed therewith, and a cover 6 is attached to the protruding portion 4*a* at one side thereof. A lead block 7 is contained and fixed inside a space surrounded by the protruding portion 4*a* and the cover 6. The lead block 7 is connected to a plurality of lead wires 8, each of which is led out from the first housing 1 and is connected to an external connector (not shown) at the distal end thereof.

The second housing 2 is constructed with a bottom plate 10 which has a circular shape and is provided with a central hole 9, and an outer cylinder 11 which project upward from the periphery of the bottom plate 10. The bottom plate 10 and the outer cylinder 11 are fixed to and joined with each other by heat staking, etc. In addition, protruding portions 10*a* and 11*a* are integrally formed with the bottom plate 10 and the outer cylinder 11, respectively, and a lead block 12 is contained and fixed in the protruding portions 10*a* and 11*a*. The lead block 12 is connected to a plurality of lead wires 13, each of which is led out from the second housing 2 and is connected to an external connector (not shown) at the distal end thereof.

The claw portion 5*b* of the inner cylinder 5 is snapped into the central hole 9 of the bottom plate 10. The peripheral portion of the top plate 4 is able to slide on the upper end portion of the outer cylinder 11, and the lower end portion of the inner cylinder 5 is able to slide inside the central hole 9. Accordingly, the first housing 1 and the second housing 2 are concentrically disposed and are linked together in a relatively rotatable manner. A ring-shaped space is formed between the first and the second housings 1 and 2, and a flexible cable 14 is wound around, for example, in a convolute manner, inside the ring-shaped space. As will be described below, one end of the flexible cable 14 is connected to the lead block 7 contained in the space surrounded by the protruding portion 4*a* and the cover 6, and the other end thereof is connected to the lead block 12 contained in the protruding portions 10*a* and 11*a*.

The second housing 2 of the rotary connector, which is constructed as described above, is attached to a stator member such as a steering column, etc. The lead wires 13, each of which is led out from the second housing 2, are connected via the external connector (not shown) to a circuit of an air bag device, etc., which is disposed in a vehicle body. In addition, the first housing 1 is attached to a steering wheel, and the lead wires 8, each of which is led out therefrom, are connected via the external connector (not shown) to an air bag inflator, etc., which is disposed in the steering wheel. In the rotary connector which is thus installed in a steering apparatus, the flexible cable 14 is wound around the inner cylinder 5 when the first housing 1 is rotated clockwise together with the steering wheel. In contrast, when the first housing 1 is rotated counterclockwise together with the steering wheel, the flexible cable 14 is loosened and moves toward the inwardly facing surface of the outer cylinder 11. Accordingly, regardless of the rotational position of the steering wheel, the circuit of the air bag device, which is disposed in the vehicle body, and the air bag inflator, etc., which is disposed in the steering wheel, are connected to each other.

Figure 4:
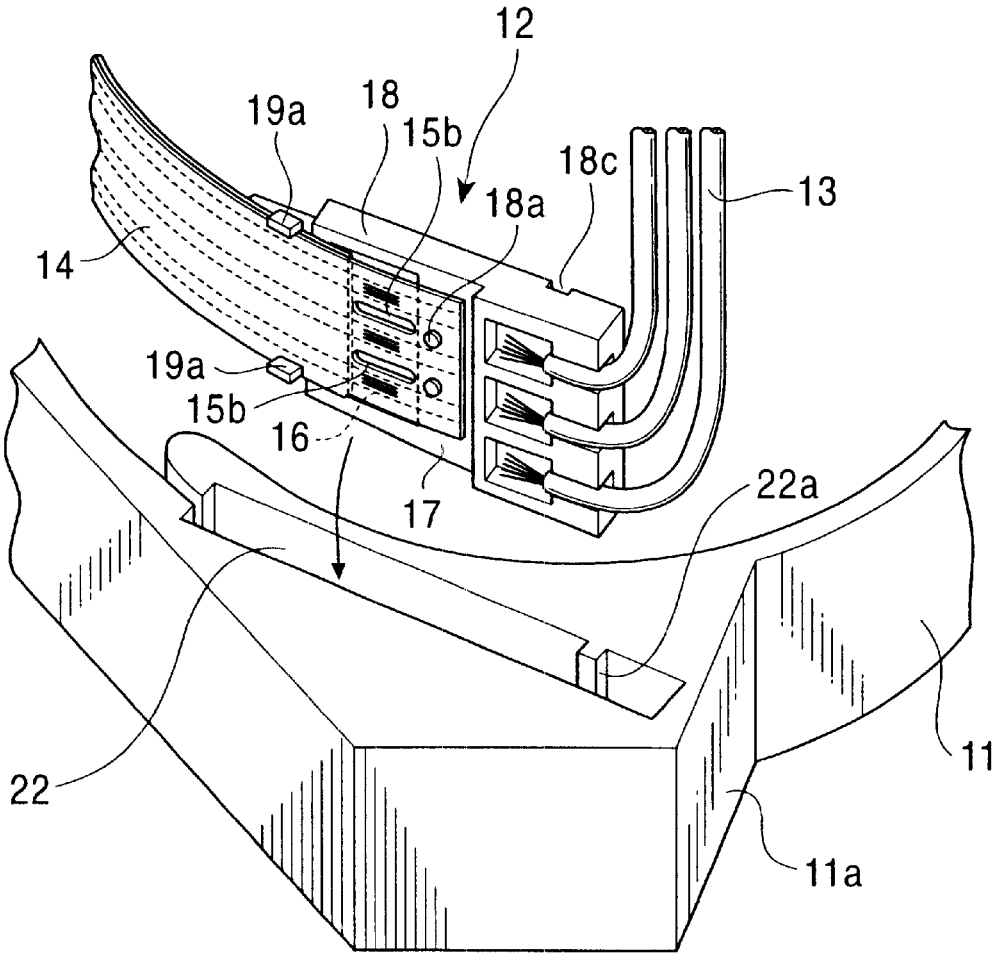
FIG. 4 is a perspective view of a connecting part of a flexible cable, a lead block, and lead wires, which are installed in the rotary connector according to the embodiment.
Figure 5:
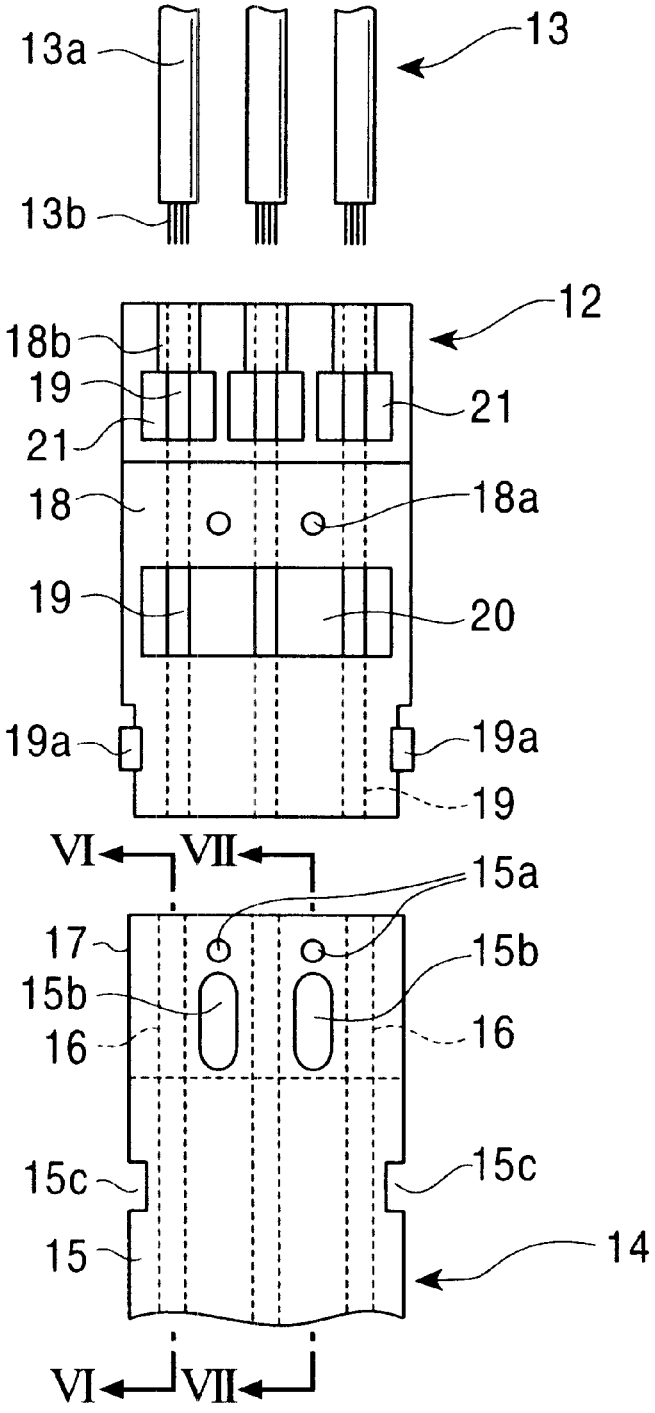
FIG. 5 is an exploded view of the connecting part shown in FIG. 4.
Figure 6:
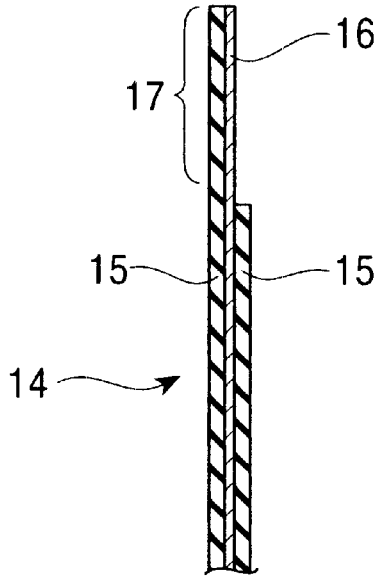
FIG. 6 is a sectional view of FIG. 5 which is cut along line VI—VI.
Figure 7:
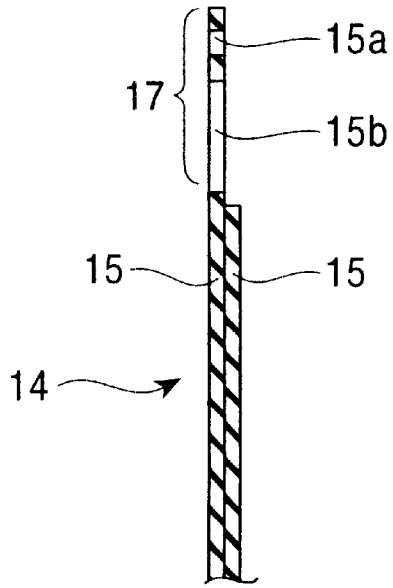
FIG. 7 is a sectional view of FIG. 5 which is cut along line VII—VII.
Figure 8:
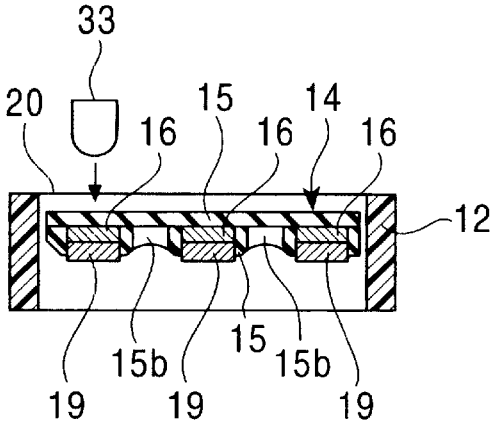
FIG. 8 is a sectional view of a connecting part of the flexible cable and the lead block.
Figure 9:
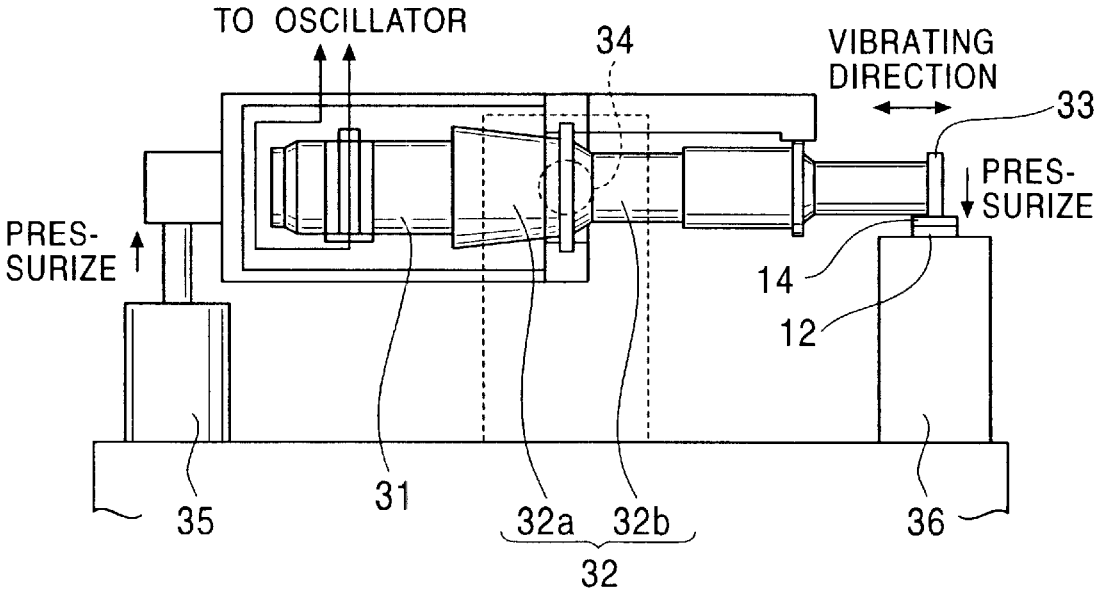
FIG. 9 is a schematic diagram of an ultrasonic welding device.

Next, with reference to FIGS. 4 to 9, a connecting structure of a flexible cable, a lead block, and lead-wires will be explained below by describing the connection of the flexible cable 14, lead block 12, and the lead wires 13 as an example. FIG. 4 is a perspective view of the connecting part of the flexible cable 14, lead block 12, and the lead wires 13 which are used in the rotary connector according to the embodiment, and FIG. 5 is an exploded view of the connecting part shown in FIG. 4. FIG. 6 is a sectional view of FIG. 5 which is cut along line VI—VI, and FIG. 7 is a sectional view of FIG. 5 which is cut along line VII—VII. FIG. 8 is a sectional view of the connecting part of the flexible cable 14 and the lead block 12, and FIG. 9 is a schematic diagram of an ultrasonic welding device.

As shown in FIG. 5, the flexible cable 14 is constructed in a band-like shape by sandwiching a plurality of conductive wires 16 with a pair of insulating films 15. In the present embodiment, the flexible cable 14 includes three conductive wires 16 for three circuits. As shown in FIGS. 6 and 7, a part of one of the insulating films 15 is removed at an end of the flexible cable 14, so that the end portions of the conductive wires 16 are exposed at the remaining insulating film 15. The end portions of the conductive wires 16 are fixed on the remaining insulating film 15, and a part including the end portions of the conductive wires 16 serves as a linking part 17. In the linking part 17, the remaining insulating film 15 is provided with positioning holes 15*a* and through holes 15*b* for preventing deformation at positions between the conductive wires 16. In addition, the flexible cable 14 is provided with notches 15*c* at positions near the linking part 17. The lead wires 13 are also referred to as round cables, and each of the lead wires 13 includes an insulating tube 13*a* and stranded wires 13*b* contained in the insulating tube 13*a*.

The lead block 12 is constructed with a resin body 18, which is insulative, and with a plurality of joint bars 19, which are conductive and are supported in the resin body 18. Corresponding to the number of conductive wires 16 included in the flexible cable 14, three joint bars 19 are provided in the present embodiment. Each of the joint bars 19 is formed of a highly conductive material such as copper, etc., in such a manner that the cross section thereof has a rectangular shape, and the surfaces at both sides are flat. The resin body 18 is provided with a first window portion 20, second window portions 21., and projections 18*a* which are disposed between the first and the second window portions 20 and 21. Each of the joint bars 19 is exposed outward through the first and the second window portions 20 and 21. The first-window portion 20 is formed as a through hole, and the second window portions 21 are formed as a plurality of through holes which are separated from each other. In addition, the resin body 18 is provided with grooves 18*b* which individually extend from the second window portions 21 toward an end of the resin body 18. The joint bars 19 are arranged with the same pitch as the pitch between the conductive wires 16 included in the flexible cable 14, and two of the three joint bars 19, which are disposed at both ends, are integrally formed with pressing plates 19*a*. The pressing plates 19*a* protrude from the side surfaces of the resin body 18 in a direction approximately perpendicular thereto.

To connect the flexible cable 14 and the lead wires 13 to the lead block 12, the flexible cable 14 is first disposed on the lead block 12 in such a manner that the exposed surfaces of the conductive wires 16 face the joint bars 19. Then, the protrusions 18*a* provided on the resin body 18 are inserted into the positioning holes 15*a* formed in the linking part 17 of the flexible cable 14. Accordingly, the flexible cable 14 is positioned relative to the lead block 12, and the conductive wires 16 individually overlap on. the flat surfaces of the joint bars 19 in the first window portion 20. In addition, the pressing plates 19*a* are disposed on the notches 15*c*. Then, the pressing plates 19*a* are bent inward, so that the bottom portions thereof are restrained inside the notches 15*c*. Accordingly, the end portion of the flexible cable 14 is fixed to the lead block 12 by the pressing plates 19*a*, so that the flexible cable 14 and the lead block 12 can be considered as a combined body in the following process.

Then, as shown in FIG. 8, a welding tip 33 installed in the ultrasonic welding device is pressed against the flexible cable 14 from above, and three pairs, each of which includes one conductive wires 16 and one joint bars 19, are sequentially processed by ultrasonic welding.

As shown in FIG. 9, the ultrasonic welding device includes a transducer 31 which converts a high-frequency electric signal transmitted from a transmitter (not shown) to a mechanical vibration; a concentrator 32 constructed with a cone 32*a* and a horn 32*b*; the welding tip 33 attached to the horn 32*b* at the tip end thereof; a fulcrum 34 which supports the concentrator 32 in such a manner that the concentrator 32 can be vibrated; an air cylinder 35 which vibrates the concentrator 32 around the fulcrum 34; and an anvil 36 which oppose the welding tip 33. The conductive wires 16 and the joint bars 19 being welded between the anvil 36 and the welding tip 33.

The welding process will be described below. First, while the anvil 36 and the welding tip 33 are separated from each other, the flexible cable 14 and the lead block 12, which are already combined by the above-described process, are disposed on the anvil 36. The flexible cable 14 and the lead block 12 are disposed in such a manner that the flexible cable 14 opposes the welding tip 33, and the lead block 12 opposes the anvil 36. Then, the air cylinder 35 is driven to move the welding tip 33 toward the anvil 36. The welding tip 33 is pressed against the flexible cable 14 at one of the opposing parts of the conductive wires 16 and the joint bars 19, and at a position close to one of the through holes 15*b* provided in the linking part 17 for preventing deformation. A predetermined pressing force is applied by the welding tip 33 and the anvil 36 to a pair including one conductive wire 16 and one joint bar 19 which are to be welded. The transmitter (not shown) is then activated to concentrate the vibrational energy (or the ultrasonic energy) generated by the transducer 31 on the welding part via the concentrator 32 and the welding tip 33. Thus, the pair including the conductive wire 16 and the joint bar 19 is processed by ultrasonic welding. The pressing force and the ultrasonic energy applied to the welding part is converted into thermal energy, and the generated heat is used for welding the pair including the conductive wire 16 and the joint bar 19 against which the welding tip 33 is pressed. The remaining pairs, each of which includes one conductive wire 16 and one joint bar 19, are sequentially welded by a similar process. In addition, before or after the welding process of the conductive wires 16 and the joint bars 19, the stranded wires 13*b* in the lead wires 13 are welded on the joint bars 19, which are individually exposed through the second window portions 21, by spot welding or by ultrasonic welding.

Due to the heat applied in the ultrasonic welding process, the remaining insulating film 15 partly melts at the region at which the welding tip 33 is pressed. However, the through holes 15*b* for preventing deformation are formed at positions close to the melted part, and deformation of the flexible cable 14 due to the melting of the remaining insulating film 15 is absorbed by the through holes 15*b*. Accordingly, the displacement between the other conductive wires 16 and the joint bars 19 is prevented. Thus, adequate electrical connections can be established for all the conductive wires 16 and the joint bars 19 without causing the displacements therebetween, and connection failures can be prevented. In addition, since special jigs or operations for fixing the flexible cable 14 are not required, the connecting process of the flexible cable 14 and the lead block 12 can be made simpler, and the manufacturing cost of the rotary connector can be reduced.

As shown in FIG. 4, after connecting the flexible cable 14 and the lead wires 13 to the lead block 12, the lead block 12 is inserted into a containing concavity 22 formed in the protruding portion 11*a* of the outer cylinder 11. The containing concavity 22 is provided with a guiding projection 22*a*, and the lead block 12 is inserted in the containing concavity 22 in such a manner that the guiding projection 22*a* slides inside a groove 18*c* formed in the resin body 18 at the rear side thereof. Thus, the lead block 12 is reliably disposed at a predetermined position inside the containing concavity 22. Then, the bottom surface of the outer cylinder 11 is covered by the bottom plate 10, and the bottom plate 10 is fixed to and joined with the outer cylinder 11 by heat staking, etc., while the lead wires 13 are led out therefrom. Accordingly, the lead block 12 is contained and fixed inside the protruding portions 10*a* and 11*a* of the second housing 2. Although detailed descriptions regarding the connecting structure at the inner end of the flexible cable 14 are omitted, it is almost the same as the above-described connecting structure except that the lead block 7 is contained inside the space surrounded by the protruding portion 4*a* and the cover 6.

In the above-described embodiment, the flexible cable 14 and the lead block 12 are combined with each other by the pressing plates 19*a* which project from both sides of the resin body 18. Thus, the combined body of the flexible cable 14 and the lead block 12 can be easily handled. In addition, since the pressing plates 19*a* are formed as parts of the joint bars 19, they can also be used for determining a the positions of the joint bars 19 in the process of forming the resin body 18. Thus, the lead block 12 can be formed by a relatively simple process. In addition, in the above-described embodiment, the notches 15*c* are formed at both sides of the insulating films 15 of the flexible cable 14, and the pressing plates 19*a* are restrained therein. Thus, a pulling force applied to the flexible cable 14 and the lead block 12 can be absorbed at the engaging parts of the notches 15*c* and the pressing plates 19*a*. Accordingly, breakage of the connecting parts of the conductive wires 16 of the flexible cable 14 and the joint bars 19 can be prevented without using a resin protector, which is difficult to form.

Although both ends of the flexible cable 14 are individually attached to the lead blocks in the above-described embodiment, the present invention is not limited to this. The construction may also be such that only one end of the flexible cable 14 is connected to the lead block 12. In such a case, the other end of the flexible cable 14 may be connected to a connector terminal provided in a connector housing, which is integrally formed with one of the housings.

In addition, although the flexible cable 14 and the lead wires 13 are connected to the lead block 12 in the above-described embodiment, the present invention is also not limited to this. A part of the lead block 12 may also be formed in the shape of a connector, so that the external connectors may directly be connected thereto.

In addition, although the through holes 15*b* for preventing deformation are formed between all of the adjacent conductive wires 16 in the above-described embodiment, the present invention is also not limited to this. When the thermal deformation of the flexible cable 14 is small, the through holes 15*b* may be provided between only some of the conductive wires 16.

In addition, although the pressing plates 19*a* are integrally formed with the joint bars 19 in the above-described embodiment, the pressing plates 19*a* may also be separately formed from the joint bars 19. For example, metal members formed of a metal which is the same as or different from the metal forming the joint bars 19 may be supported by the resin body 18 with the joint bars 19 in such a manner that parts of the metal members protrude from the resin body 18. In addition, according to the present invention, the pressing plates 19*a* may also be omitted.

In addition, although the flexible cable 14 and the lead block 12 for three circuits are described in the above-described embodiment as an example, there are no limits to the number of conductive wires 16 in the flexible cable 14 and to the number of joint bars 19 in the lead block 12. The present invention may be applied to the flexible cable 14 having an arbitrary number of conductive wires 16 and the lead block 12 having an arbitrary number of joint bars 19 in accordance with requirements.

What is claimed is:

1. A rotary connector comprising:

a pair of housings which are concentrically disposed and are linked together to be rotatable relative to each other;

a flexible cable which is contained in a space between the housings such that the flexible cable is able to be wound and loosened therein, and which is formed in a band-like shape by sandwiching a plurality of conductive wires between two insulating films; and a lead block which is connected to an end of the flexible cable and has a plurality of conductive joint bars supported by an insulating supporter;

wherein, in a part of the flexible cable which is connected to the lead block, one of the two insulating films is removed leaving end portions of the conductive wires exposed at the remaining insulating film, through holes being formed in the remaining insulating film at positions between the exposed conductive wires, and the exposed conductive wires being electrically connected to the joint bars at positions close to the through holes.

2. A rotary connector according to claim 1, wherein the through holes are provided between all the conductive wires on the remaining insulating film and are arranged in a line.

3. A rotary connector according to claim 1, wherein the through holes are provided between only some of the conductive wires on the remaining insulating film.

* * * * *